US007101103B1

(12) United States Patent
Dietz

(10) Patent No.: US 7,101,103 B1
(45) Date of Patent: Sep. 5, 2006

(54) ILLUMINATED WRITING INSTRUMENT WITH MAGNETIC RETAINER CLIP

(76) Inventor: Dan L. Dietz, 10234 Emerald Dr., Houston, TX (US) 77074

( * ) Notice: Subject to any disclaimer, the term of this patent is extended or adjusted under 35 U.S.C. 154(b) by 0 days.

(21) Appl. No.: 11/120,687

(22) Filed: May 3, 2005

(51) Int. Cl.
*B43K 29/00* (2006.01)
*B43K 23/02* (2006.01)
*B43K 29/10* (2006.01)
*B43K 25/00* (2006.01)

(52) U.S. Cl. ..... 401/195; 401/131; 362/118; 24/11 HC; 24/11 M

(58) Field of Classification Search ..... 401/52, 401/131, 195; 362/118; 24/10 R, 11 R, 24/11 CC, 11 HC, 11 M, 11 P, 11 FE
See application file for complete search history.

(56) References Cited

U.S. PATENT DOCUMENTS 1,222,948 A * 4/1917 Hawthorne ..... 362/118
2,189,715 A * 2/1940 Selmer ..... 24/557
2,297,806 A * 10/1942 Smith ..... 211/69.1
2,644,212 A * 7/1953 Markowitz ..... 24/11 R
3,879,859 A * 4/1975 English ..... 434/159
4,047,017 A * 9/1977 Herring ..... 362/118
D272,802 S * 2/1984 Dall-Winther ..... D8/396
4,799,132 A * 1/1989 Perlsweig ..... 362/118
5,142,161 A * 8/1992 Brackmann ..... 250/566
6,048,124 A * 4/2000 Kawabe ..... 401/243

* cited by examiner

*Primary Examiner*—David J. Walczak
(74) *Attorney, Agent, or Firm*—Darcell Walker

(57) ABSTRACT

An improved illuminated writing instrument comprises a writing element, a lighting element and an attaching element. The writing and lighting elements are secured to each other via the attaching element. The attaching element comprises a combination dual clip and a retainer clip. A dual opening clip attaches the writing instrument and the illuminating instrument such that the two instruments form one illuminated writing instrument. The invention further comprises a magnetic retainer clip to secure the illuminated writing instrument as desired by the user. In operation, the force from the magnetic field of the retainer magnet will draw the arm to the magnet. The force of the magnetic field is an amount that will secure the arm to the magnet thereby creating the mechanism that will provide the securing capabilities of the retainer clip. This clip will have the capability of securing the illuminated writing instrument as desired by the user.

11 Claims, 3 Drawing Sheets

ILLUMINATED WRITING INSTRUMENT WITH MAGNETIC RETAINER CLIP

FIELD OF THE INVENTION

The present invention relates to an illuminated writing instrument and in particular to an improved illuminated writing instrument comprising an attaching element to facilitate securing the writing instrument and the illuminating instrument into one functional device. The present invention further comprises a magnetic clip for securing the illuminated writing instrument when the writing instrument is not in use.

BACKGROUND OF THE INVENTION

Written communications have been a primary means of communication dating back to the medieval period. As early as the $4^{th}$ century, people used crude writing instruments to communicate information. These instruments consisted of hollow straws or reeds that supported a short column of liquid. During the fifth century, people began to make pens formed from wing feathers. Currently, the writing pen has evolved into a variety writing instruments, which include: the ballpoint pen, the fountain pen, the soft-tip pen lettering pin and the technical pin. Today, pens rank among the most widely used writing instrument.

One concept of the writing instrument is to attach a light such as a flashlight to the instrument. This combination enables the user to be able to see the surface on which they are writing when the surrounding light is inadequate. For many years, there have been several versions of the illuminated writing instrument.

U.S. Pat. No. 1,516,647 describes a pencil illuminating light. This device comprised a writing pencil having a light contained in a light receptacle that was coupled to it the writing pencil. A wire connected the receptacle to a portable power source.

U.S. Pat. No. 1,615,740 describes a writing instrument and completely separate lighting instrument joined by clips that extended from the lighting instrument. These clips were able to engage the writing instrument and secure the lighting instrument to the writing instrument.

U.S. Pat. No. 2,964,614 describes a ballpoint pen with a light bulb disposed adjacent the ballpoint. The pen and light bulb are encased within one housing. In addition, the act of depressing the end of the pen to shift the pen into the writing position would also activate the source of light. Shifting the pen back to a closed position would deactivate the light source. With this device, the user could only write with the light on.

U.S. Pat. No. 4,002,349 describes a ski clip device for securing a pair of skis together in a base-to-base relationship and for holding a ski pole. The device includes first and second generally elongate clip members, each of which is formed to define a channel therein, with each end of the clip members being open. The clip members are attached together in a back-to-back relationship so that the channels thereof face in generally opposite directions.

U.S. Pat. D272,802 describes a penlight holder having elongated clip members. These members are attached together back to back so that defined channels in each clip face generally opposite directions.

U.S. Application 20020044442 describes a writing apparatus having permanently attached writing and lighting instruments. Each instrument would be activated separately.

This apparatus also has a conventional clip to secure the apparatus to the clothing of the user.

Writing instruments have also contained clips used to secure the instrument to the clothing of the user. U.S. Pat. No. 5,152,626 describes a writing instrument that includes a clip, which can be retracted into an opening of a barrel, and an operating unit, which has a pushbutton and an operating cam. The writing instrument can be operated by a single operating means, while the clip can function only when the writing cartridge is retracted.

U.S. Pat. No. 6,685,374 describes a spring biased clip design. This clip assembly is securably affixable to the body of a variety of hand-held implements, including writing devices, which is capable of clasping objects substantially thicker that a garment pocket, such as notepads, books, and backpacks. The clip assembly comprises a pin securably engaged to the body of the hand-held implement, a rigid member having a first end for clasping an article, and a second end for manually operating the clip assembly, and a spring biasing the first end of the rigid member towards the body of said hand-held writing implement.

U.S. Pat. No. 6,499,196 A clip for a writing instrument has an external biasing mechanism separate from the connection of the clip to the writing instrument to avoid permanent deformation or breaking of the clip arm and wear on the writing instrument body. The biasing mechanism is a coil spring mounted on the clip arm between two supports for compression and flexion when the clip arm is pulled away from the side of the writing instrument.

While there are many devices designed to provide a light source for a writing instrument when the surrounding light is inadequate, these devices do not have a reliable means to secure the device when the device is not in use. There remains a need for an illuminated writing instrument that can be reliably secured to the clothing of the user.

SUMMARY OF THE INVENTION

It is an objective of the present invention to provide an illuminated writing instrument having distinct writing and illuminating instruments and a retainer clip to secure the illuminated writing instrument as desired by the user.

It is second objective of the present invention to provide an attaching element that can securely hold both a writing instrument and an illuminating instrument.

It is a third objective of the present invention to provide a magnetic retainer clip to secure the illuminated writing instrument as desired by the user.

It is fourth objective of the present invention to provide a magnetic retainer clip with replaceable magnets.

It is a fifth objective of the present invention to provide a combined clip device for attaching the writing and illuminating instruments and for securing the illuminated writing instrument as desired by a user.

The present invention provides an improved illuminated writing instrument and system. The invention comprises an elongated writing instrument such as a pencil or pen. The invention further comprises an elongated lighting source that attaches to the writing instrument. A dual opening clip attaches the writing instrument and the illuminating instrument such that the two instruments form one illuminated writing instrument. The invention further comprises a magnetic retainer clip to secure the illuminated writing instrument as desired by the user.

The retainer clip comprises a base, a retainer magnet attached to the base and a securing arm. The base magnet is positioned at one end of the base. The arm is connected to the base at the end opposite the base magnet. The arm connects to the base in a manner that enables the arm to pivot. At least the end portion of the arm opposite the pivot comprises a magnetic material. In operation, the force from the magnetic field of the base magnet will draw the arm to the magnet. The force of the magnetic field is an amount that will secure the arm to the magnet thereby creating the mechanism that will provide the securing capabilities of the retainer clip. This clip will have the capability of securing the illuminated writing instrument as desired by the user.

DETAILED DESCRIPTION OF THE INVENTION

Figure 1:
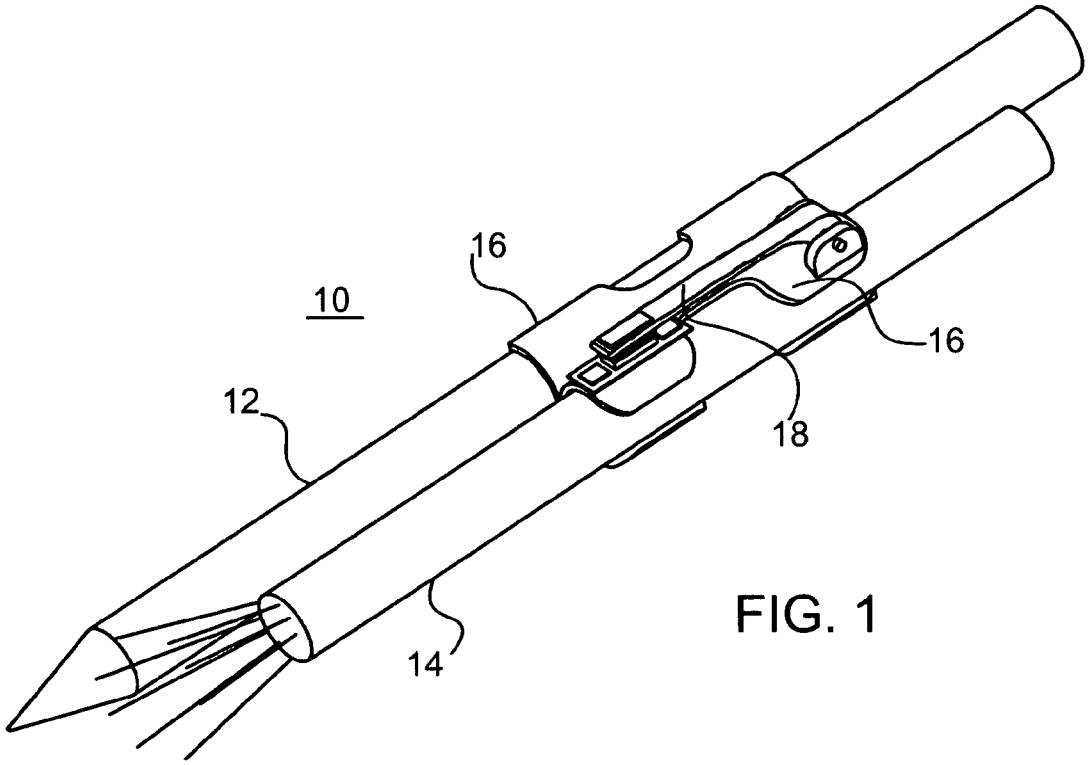
FIG. 1 shows a front, top, and side view of the illuminated writing instrument of the present invention.

FIG. 1 shows a top, front and side view of the illuminated writing instrument of the present invention. The instrument 10 contains a writing element 12, a lighting element 14, a dual clip element 16 and a retainer clip 18 attached to the dual clip. The writing element 12 can be any conventional writing instrument including pencils or pens. The writing instrument should have a generally elongated shape. The preferred surface of this element should be rounded smooth, which would result in a circular surface contour. However, other writing instrument surfaces will work within the design of this invention. As with the writing instrument, the light instrument 14 should also be have an elongated shape. This instrument also has a generally rounded surface. The power source for the lighting element is usually contained within the lighting element. In some instances such as with an optic cable lighting element, the power source may be external.

Figure 2:
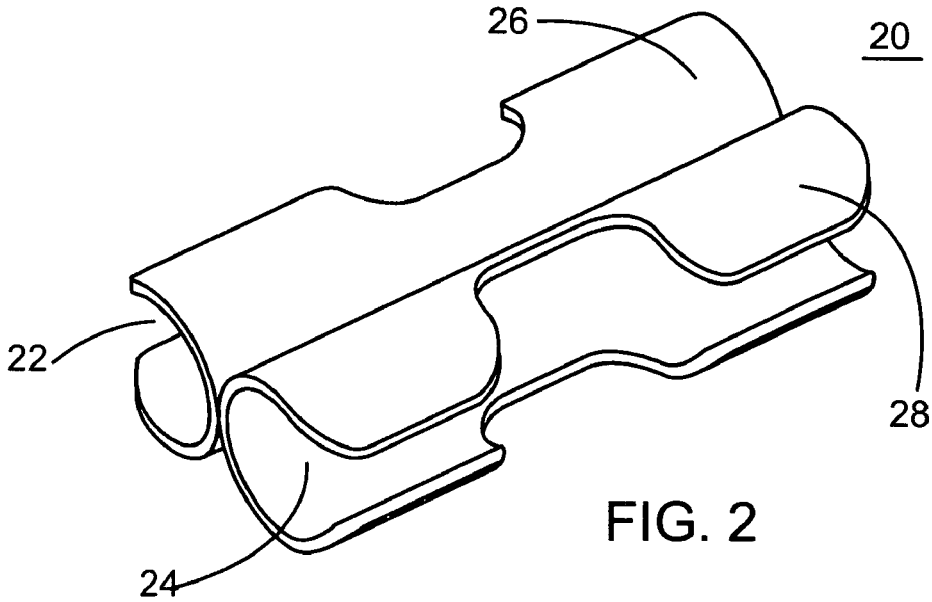
FIG. 2 shows a front, top, and side view of the dual clip apparatus of the present invention.

Referring to FIG. 2, there is shown a dual clip 20 adapted to secure a writing instrument and illuminating instrument pair together in a back-to-back relationship as shown in the drawing. The dual clip comprises an elongate clip 20 formed to define a pair of channels 22 and 24. The clip 20 might, for example, be constructed of a pair of tubular members 26 and 28 attached together in a back-to-back relationship so that the respective channels 22 and 24 face generally in opposite directions. Each tubular shaped element includes an outer wall having a continuous uniform surface as well as a continuous back section. The clip 20 can be constructed of an elastic material such as plastic nylon, polyurethane, etc., to allow flexing of the walls of the channels.

Figure 3:
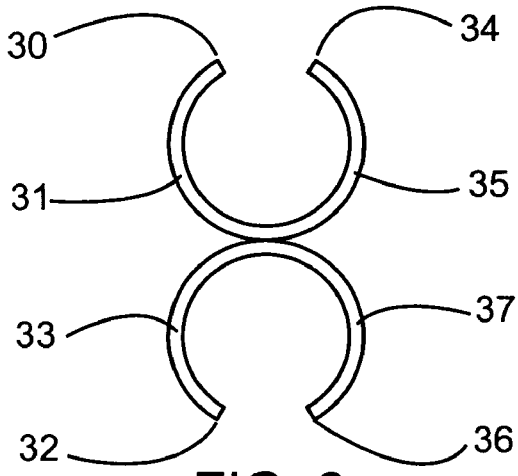
FIG. 3 shows a top cross-section view of the dual clip apparatus of the present invention.

Referring to FIG. 3, the tubular members 26 and 28 are open at each end and on opposite sides, with the sides of the channel openings being defined by outer terminations or tab sections 30, 32, 34 and 36 of side walls 31, 33, 35 and 37 of the tubular members. The channel 22 and the corresponding side opening thereof can be dimensioned to receive either the writing or illuminating instruments. In an alternate embodiment, the channels 22 and 24 can have different dimensions to specifically receive wither the writing instrument or the illuminating instrument. The different dimensions for the channels may be necessary because many times the dimensions of the writing instrument are different from the dimensions of the illuminating instrument.

Figure 4:
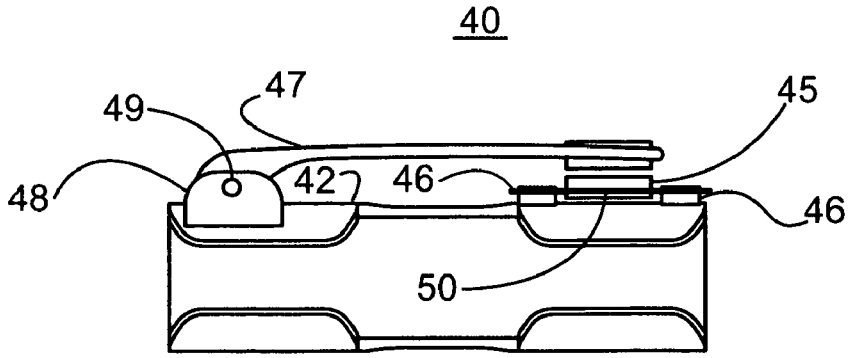
FIG. 4 shows a side view of the magnetic retainer clip of the present invention in a closed and secured position.
Figure 5:
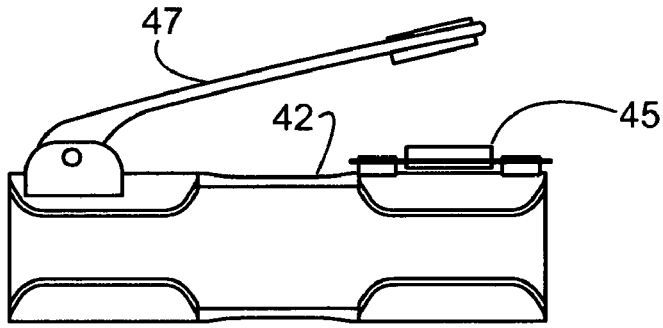
FIG. 5 shows a side view of the magnetic retainer clip of the present invention in an open position.

FIG. 4 illustrates the retainer clip 40 of the present invention in a closed position. As shown, this retainer clip has a base 42 with upper and lower surfaces. At least a portion of the lower surface is in contact with the dual clip 20. On the upper surface is a retainer magnet 45. This magnet is positioned at one end of the base 42. The magnet can be affixed between two poles 46 the secure the magnet to the base and to facilitate replacement of the magnet. The retainer arm 47 is attached to the opposite end of the upper surface from the retainer magnet. The retainer arm is attached in a manner that allows the arm to pivot several degrees with reference to the base. The mechanism that attaches the retainer arm to the base can be a stand 48. A pin can extend through the retainer arm and stand in order to secure the arm to the stand and thereby to the base. In addition, the pin 49 would serve as the pivot point for the rotary movement of the retainer arm.

Figure 6:
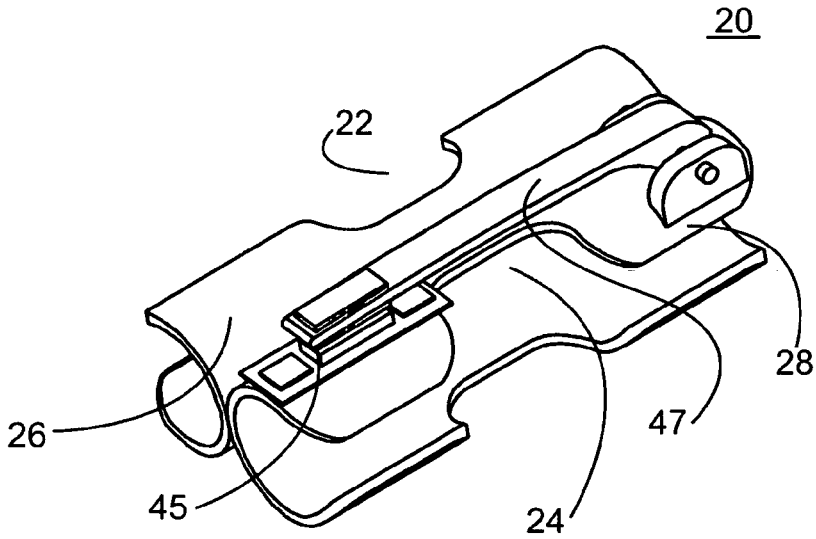
FIG. 6 is a top, front and side view of dual clip and retainer clip combination of the present invention.
Figure 7:
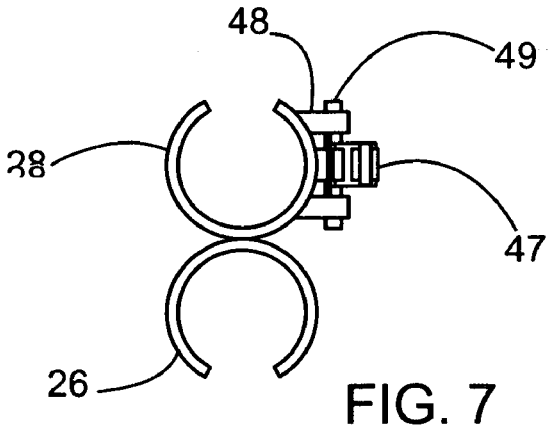
FIG. 7 is a top cross-section view of the dual clip and retainer clip combination of the present invention.

The retainer arm 47 can be of a magnetic material or it can have only a section that comprises a magnetic material. This magnetic material can interact with the magnet to form the clamp to secure the illuminated writing instrument of the present invention to an object. FIGS. 6 and 7 show the attachment of the dual clip and the retainer clip. As shown, the retainer clip attaches to the wall of one of the dual clips. Also as mentioned, the magnets can be replaced as needed by the user. As shown in FIG. 4, a bar 50 can extend between poles 46 and over the retainer magnet 45 to secure the magnet to the base.

In an alternate embodiment, the retainer clip can be implemented without the base 42. In this embodiment, the stand 48 and poles 46 would attach directly to the wall of one of the channels of the dual clip. The retainer magnet 45 could also attach to the channel wall between the two poles with bar 50. The retainer arm 47 would attach to the stand 48 in the same manner as if the base were present. The present invention can also implement biased spring. In this approach, the spring could provide additional securing force.

In the implementation of the invention, the user would insert the illuminating instrument and the writing instrument into the two channels 22 and 24 of the dual clip. The next step is to secure the illuminated writing instrument to an object. In practice, a typical object would be a clothing item of the user. At this time, the retainer clip would be in the closed position. The user would exert pressure to rotate the retainer arm to the open position. The user would then position the clip such that a portion of the clothing garment would extend between the retainer arm 47 and the base 42. Next the user releases the retainer arm. At this point, the magnetic force from the magnet draws the retainer arm back to the closed position such that the arm and magnet form a clamp on the inserted material to secure the illuminating writing instrument to the user.

Figure 8:
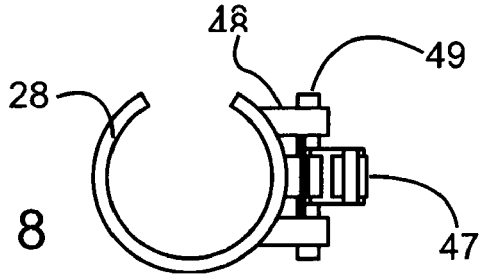
FIG. 8 is a top cross-section view of a single clip and magnetic retainer clip combination.

An additional embodiment of the present invention as shown in FIG. 8 comprises the implementation of a single clip combined with the magnetic retainer clip of the present invention. With this embodiment, the user will only be able to attach either the writing instrument or the illuminating instrument to the retainer clip. FIG. 8 shows a tubular member 28 open at each end and on opposite sides. The retainer clip attaches to the tubular member 28. As previously described, the retainer arm 47 is attached to the opposite end of the upper surface from the retainer magnet. The retainer arm is attached in a manner that allows the arm to pivot several degrees with reference to the base. The mechanism that attaches the retainer arm to the base can be a stand 48. A pin can extend through the retainer arm and stand in order to secure the arm to the stand and thereby to the base. In addition, the pin 49 would serve as the pivot point for the rotary movement of the retainer arm.

The writing instrument of this invention provides significant advantages over the current art. The invention has been described in connection with its preferred embodiments. However, it is not limited thereto. Changes, variations and modifications to the basic design may be made without departing from the inventive concepts in this invention. In addition, these changes, variations and modifications would be obvious to those skilled in the art having the benefit of the foregoing teachings. All such changes, variations and modifications are intended to be within the scope of this invention.

I claim:

1. An illuminated writing instrument comprising:

a writing element;

an illuminating element;

a dual clip having a pair of tubular shaped elements, each said tubular shaped element having an open side and two open ends such that each element forms a channel, each tubular shaped element also having a closed side which is an outer wall, with the closed sides of the tubular shaped elements being joined; and a magnetic retainer clip, having a retainer magnet and a retainer arm, the retainer magnet and retainer arm being positioned on the dual clip, the magnet and the retainer arm of said magnetic retainer clip are attached directly to an outer wall of one of the tubular shaped walls of said dual clip, the retainer clip further having a stand for securing a pivot end of the retainer arm to the tubular wall, a pivot pin extending through the stand and pivot end of the retainer to provide a pivot point for the retainer arm to rotate and poles positioned adjacent the retainer magnet to secure the retainer magnet to the tubular wall.

2. The illuminated writing instrument as described in claim 1 wherein said retainer arm comprises a magnetic material.

3. The illuminated writing instrument as described in claim 1 wherein said retainer arm comprises a composite material having a magnetic end that engages the retainer magnetic.

4. The illuminated writing instrument as described in claim 1 further comprising a bar extending through said poles positioned adjacent said retainer magnet to further secure said retainer magnet to said tubular wall.

5. The illuminated writing instrument as described in claim 1 wherein each tubular shaped element comprises an outer wall, said outer wall having a continuous uniform surface.

6. The illuminated writing instrument as described in claim 1 wherein each tubular shaped element comprises an outer wall, said outer wall comprises a continuous back section and tab sections that extend from said back section and engage said writing and illuminating elements.

7. An illuminated writing instrument comprising:

a writing element;

an illuminating element, a dual clip having a pair of tubular shaped elements, each said tubular shaped element having an open side and two open ends such that each element forms a channel, each tubular shaped element also having a closed side which is an outer wall, with the closed sides of the tubular shaped elements being joined; and a magnetic retainer clip, having a retainer magnet and a retainer arm, a retainer base section that attaches directly to an outer wall of one of the tubular shaped walls of said dual clip, the retainer magnet and retainer arm being attached to the retainer base section of the retainer clip, the retainer clip further having a stand for securing a pivot end of the retainer arm to the base section, a pivot pin extending through the stand and pivot end of the retainer arm to provide a pivot point for the retainer arm to rotate and poles positioned adjacent the retainer magnet to secure the retainer magnet to the base section.

8. The illuminated writing instrument as described in claim 7 wherein said retainer arm comprises a magnetic material.

9. The illuminated writing instrument as described in claim 7 wherein said retainer arm comprises a composite material having a magnetic end that engages the retainer magnetic.

10. The illuminated writing instrument as described in claim 7 further comprising a bar extending through said poles positioned adjacent said retainer magnet to further secure said retainer magnet to said tubular wall.

11. A combination clip comprising:

a dual clip having a pair of tubular shaped elements, each said tubular shaped element having an open side and two open ends such that each element forms a channel, each tubular shaped element also having a closed side with the closed sides of the tubular shaped element being joined; and a magnetic retainer clip, having a retainer magnet and a retainer arm, the retainer magnet and retainer arm being positioned on the dual clip, the magnet and the retainer arm of said magnetic retainer clip are attached directly to an outer wall of one of the tubular shaped walls of said dual clip, the retainer clip further having a stand for securing a pivot end of the retainer arm to the tubular wall, a pivot pin extending through the stand and pivot end of the retainer arm to provide a pivot point for the retainer arm to rotate and poles positioned adjacent the retainer magnet to secure the retainer magnet to the tubular wall.

* * * * *